United States Patent [19]

Yantsen et al.

[11] Patent Number: 4,658,913

[45] Date of Patent: Apr. 21, 1987

[54] HYDROPNEUMATIC PERCUSSIVE TOOL

[76] Inventors: Ivan A. Yantsen, bulvar Mira, 40, kv. 2, Karaganda; Kenes K. Bekishev, ulitsa Furmanova, 148, kv. 50, Alma-Ata; Orest G. Savchak, ulitsa Satpaeva, 58, kv. 1; Alexandr B. Klok, ulitsa gogolya, 64, kv. 25, both of Karaganda; Tolgat M. Zhanabaev, ulitsa Vesnovskaya, 19, kv. 51, Alma-Ata; Mechislav-Valentinas K. Pakshtas, ulitsa Studencheskaya, 12, kv. 56, Mozyr; Boris N. Glotov, prospekt Lenina, 81, korpus 1, kv. 73, Karaganda; Garold K. Fink, ulitsa Shvernika, 1, kv. 11, Tselinograd; Alexel F. Timkin, Zeleny proezd, 45, korpus 6, kv. 16, Kalinin; Nikolai I. Zorin, Changarsky bulvar, 11, kv. 26; Leonid M. Bobylev, ulitsa Petrozavodskaya, 15, korpus 2, kv. 22, both of Moscow, all of U.S.S.R.

[21] Appl. No.: 683,799

[22] Filed: Dec. 19, 1984

Related U.S. Application Data

[62] Division of Ser. No. 384,492, Jun. 3, 1982, Pat. No. 4,505,340.

[51] Int. Cl.[4] ..... B25D 9/00

[52] U.S. Cl. ..... 173/134; 91/222; 173/13; 173/14

[58] Field of Search ..... 173/134, 126, 127, 119, 173/13–17; 91/222, 226, 227, 228, 331, 422

[56] References Cited

U.S. PATENT DOCUMENTS

| | | | |
|---|---|---|---|
| 672,638 | 4/1901 | Dunlop | 91/226 |
| 1,350,342 | 8/1920 | Smith | 91/231 |
| 3,322,207 | 5/1967 | Foster | 91/222 X |
| 3,456,742 | 7/1969 | James | 173/119 |
| 4,165,788 | 8/1979 | Montabent | 173/17 |
| 4,505,340 | 3/1985 | Yantsen et al. | 173/134 |
| 4,552,227 | 11/1985 | Wohlwend | 173/15 |

*Primary Examiner*—E. R. Kazenske
*Assistant Examiner*—Willmon Fridie, Jr.
*Attorney, Agent, or Firm*—Burgess, Ryan & Wayne

[57] ABSTRACT

A vibration or reciprocating hydraulically driven impact tool for breaking up paving, compacting soil, or similar construction purposes. The tool employs a piston situated in a housing and configured to form (in cooperation with the housing) three chambers. One of the chambers is filled with a compressed gas which acts as a shock absorber/spring, with the other two chambers serving to drive adjacent flanges of the piston in opposite directions to provide reciprocating action. The device is constructed so that when no mechanical force is applied to the handle, the piston is at rest in its forward position (being urged there by the compressed gas), with the hydraulic forces acting upon the piston shoulders being balanced. When the handle is pushed forward, the hydralic system is altered so that unbalanced forces act on the piston flanges, causing the piston to start moving. Thereafter, a hydraulic valve system provides the desired reciprocating motion of the piston.

2 Claims, 3 Drawing Figures

HYDROPNEUMATIC PERCUSSIVE TOOL

This is a division of application Ser. No. 384,492, filed June 3, 1982, now U.S. Pat. No. 4,505,340.

BACKGROUND OF THE INVENTION

The present invention relates to civil engineering and road construction machinery, and more particularly to a hydropneumatic percussive tool.

The invention can find application in compacting cohesive and loose soils of various physical and mechanical properties in conjested areas, breaking up concrete and asphalt concrete pavements or rock, shattering firm and frozen ground, and driving piles.

The invention may also be utilized in other industrial fields where it is necessary to provide considerable impact loads on working implements at relatively small overall dimensions of the source of such impact loads, for example, in the mining and metallurgical industries, as well as in mechanical engineering and public utilities.

As is known, percussive machines are generally classified into pneumatic or air powered (various jack, riveting, chopping hammers, concrete breakers, drills and soil compactors), electric (normally hand-operated machines with low impact power) and hydraulic (ranging from small hand-operated ones to large machines with impact energy of up to 10,000 j).

Inherent in hand-operated percussive machines of known construction are high levels of noise and vibration causing such an occupational hazard as vibrotrauma. Vibration also results in reduced power, efficiency and reliability of percussive machines which in turn affect the productivity and quality. Direct contact of the operator with such machines dictates some special safety features to be incorporated into their design in terms of reducing their weight, the level of vibration and eliminating the hazard of electric shock.

A study of techniques used to reduce recoil and vibration of percussive tools has shown that the modern trend is toward the provision of dynamically balanced machines of high impact frequency and power. A most optimum arrangement is the one where the piston hammer cooperates with an added mass or body without actually striking it, this body being stopped for effecting a return stroke with recuperation of energy. Such an arrangement assures reduced recoil, vibration and noise, along with improved performance compared with other known arrangements.

It is a common knowledge that pneumatic percussive tools, especially manually operated tools, are most noise and vibration hazardous. Electric percussive machines also feature high level of vibration along with heavy weight and low impact power.

An increasingly growing trend lately is toward making use of hydraulic power drives in various branches of the national economy, particularly in road construction machinery and civil engineering; this being caused by a number of advantages offered by hydraulic drives versus other power sources.

One promising direction taken by designers of new tools is to produce detachable mounted equipment well suited for the existing basic hydraulic machines.

This has given an impetus to create highly efficient, low-noise and low-vibration percussive machines powered by multi-purpose hydraulic drives.

At present, there are known numerous constructions of hydraulic and hydropneumatic percussive tools.

A hydropneumatic percussive tool is known (cf. USSR Inventor's Certificate No. 564,415, IPC E21C 3/20) comprising a housing having an implement and radial passages connected to pressure and discharge hydraulic lines. Arranged inside the housing is a reciprocating piston hammer of stepped configuration defining in conjunction with the housing three chambers, one of which communicates by way of passages with the pressure line, the second one connects to the discharge line, while the third chamber is filled with a compressed gas to functions as a pneumatic accumulator. The tool also comprises a hydraulic two-state distributor controlled according to the position of the piston hammer having in the cylindrical interior thereof a control valve separating this interior into two portions, the hydraulic distributor being provided with radial and axial passages, one of the passages being fitted with a flow restrictor. By means of the passages of the distributor, one of the two portions of the cylindrical interior is connected to the chamber of the housing which communicates with the pressure line, whereas the other portion is connected with another chamber of the housing communicating with the discharge line, the output stage of the hydraulic distributor defining in conjunction with the stepped configuration of the housing two chambers of various diameters, the chamber of smaller diameter continuously communicating with a flow control distributor formed by two grooves made on the step of smaller diameter of the piston hammer and by two recesses in the step of the housing which contacts with the step of smaller diameter of the piston hammer.

The movement of the control valve to effect the idle and work strokes of the piston hammer is caused by the liquid supplied by a pump. However, the pump delivery rate is not fully utilized when the control valve moves in a position enabling the piston hammer to effect its work stroke, as part of the liquid delivered by the pump tends to escape through the flow restrictor arranged in the passage communicating the chamber of the hydraulic distributor connected to the discharge line whereby the movement of the control valve is slowed down or delayed resulting in a reduced frequency of impacts produced by the piston hammer and consequently in weakened impact power thereof. Another disadvantage of the above construction resides in complicated techniques employed for manufacturing the hydraulic distributor because the latter must be provided with a variety of grooves, axial and radial passages, as well as due to that the control valve must be provided with two mounting surfaces.

In addition, the recoil reaction acting on the housing and occuring during the work stroke of the piston hammer when the pressure of liquid in the housing chambers communicating with the pressure and discharge lines is equal, while the compressed gas occupying the pneumatic accumulator has an overpressure, is directed against the path of travel of the piston hammer. The maximum value of the recoil reaction is determined by a product of the overpressure of the compressed gas by the piston hammer area. In the return stroke the piston hammer moves in a direction opposite to the work stroke thereof; in consequence, the direction of the recoil reaction also changes. Therefore, the recoil reaction alternates.

Also known is a hydropneumatic percussive tool provided with a means for damping a recoil reaction (cf. USSR Inventor's Certificate No. 579,134, IPC B25D 9/12, E21C 3/22) comprising a housing having radial passages communicating with pressure and discharge hydraulic lines. Arranged inside the housing for axial reciprocations therein is a stepped piston hammer having steps of larger and smaller diameters separating the interior of the housing into three chambers, one of the chambers communicating by way of a passage with the pressure line, the second chamber connects to the discharge line, whereas the third one is defined by the step of larger diameter and the inner walls of the housing and is filled with a compressed gas to serve as a pneumatic accumulator. An inertia piston is provided arranged in the housing coaxially with the piston hammer and having steps of larger and smaller diameters equal to the corresponding diameters of the piston hammer, the inertia piston defining with the housing two chambers, one of which is connected by way of a passage to the pressure line, the other chamber defined by the housing and the step of larger diameter being filled with a compressed gas to serve as a pneumatic accumulator. The piston hammer is provided with a hydraulic distributor having radial and axial passages, a cylindrical chamber of the distributor accommodating a spring-loaded control valve separating this chamber into two portions one of which is continuously connected by way of passageways to the chamber communicating with the discharge line, the other one being connected with a groove made on one of the steps of larger diameter of the piston hammer. In addition, the hydraulic distrubitor is provided with a radial passage periodically closed by the control valve and continuously communicating with the chamber which is connected to the pressure line, the two pneumatic accumulators being separated by a rigid wall although communicating with each other, the pressure inside the pneumatic accumulator of the piston hammer being in excess of the pressure in the pneumatic accumulator of the inertia piston, the chambers communicating with the pressure line being connected therebetween by a pipe provided with a check valve.

When a liquid is delivered from a pump into the chambers connected to the pressure line, it acts on the piston hammer and the inertia piston which are caused to move toward each other thereby compressing the gas contained in the pneumatic accumulators (idle stroke of the piston hammer). At the end of the idle stroke the piston hammer closes by the step of larger diameter the passage of the housing which is connected to the discharge line to discommunicate therefrom the chamber normally connected therewith. The liquid in this chamber acts on the control valve which in turn begins to move and opens the passage of the hydraulic distributor connected to the chamber communicating with the pressure line. When this passage opens, the chambers connected to the pressure and discharge lines intercommunicate to equalize the pressure of liquid therein. Under the action of the compressed air in the two pneumatic accumulators the piston hammer and the inertia piston accelerate (work stroke of the piston hammer). At the end of the work stroke the piston hammer strikes against the implement, whereas the control valve induced by the spring acts to close the passage of the hydraulic distributor connected to the chamber which is communicating with the pressure line. Therewith, the inertia piston decelerates due to the liquid being forced out of the chamber defined by the inertia piston and the housing and communicating with the pressure line into the chamber formed by the piston hammer and the housing causing the piston hammer to move in the direction of the idle stroke and compressing the gas in the pneumatic accumulator. After the piston hammer and the inertia piston have stopped, the flow of liquid occupying the chamber formed by the piston hammer and the housing and connected to the pressure line is closed by the check valve. The liquid delivered by the pump causes the inertia piston to move in the direction of the idle stroke thereby compressing the gas in the pneumatic accumulator. When pressure in the two hydraulic accumulators equalizes, the check valve opens and the liquid is admitted to the two chambers connected to the pressure line, this being accompanied by a syncronous movement of the piston hammer and the inertia piston, whereupon the cycle is repeated.

The above device is disadvantageous in that it is large in size and heavy in weight because of the use of the inertia piston which also complicates its construction.

In the course of operation the spring of the control valve weakens resulting in delayed closing of the passage of the hydraulic distributor which is connected to the pressure line. This arrangement of the hydraulic distributor fails to provide high frequency percussions due to the delayed action of the control valve and limited spring life.

Recoil reaction in heretofore described device is reduced through the use of the inertia piston moving in a direction opposite to the movement of the piston hammer. The recoil reaction from the piston hammer and the inertia piston is directed opposite to their movement, the resulting force acting on the housing being equal to the algebraic sum, whereby the force of the recoil reaction is reduced. However, the inertia piston provided in the housing to serve as a means for reducing the recoil reaction fails to effect a useful function.

The resulting value of the recoil reaction is determined by the forces acting in the chambers of the pneumatic accumulators and the chambers connected to the pressure and discharge lines caused by the pressure of the compressed gas and that of the working fluid whose respective values tend to vary within a wide range thereby leading to alternating recoil reaction.

There is further known a hydraulic percussive tool (cf. USSR Inventor's Certificate No. 761,652, IPC E01C 19/30, E02D 3/046, published 1975) comprising pressure and discharge hydraulic lines, a housing having a piston hammer secured in guiding sleeves separating the interior of the housing into chambers connected by passages to the pressure and discharge hydraulic lines, and a chamber serving as a pneumatic accumulator. Attached to the housing is a hydraulic distributor the cylindrical interior of which accommodates a spring-loaded control valve separating it into two portions one of which communicates continuously by way of one of the passages of the hydraulic distributor with the chamber of the housing connected to the discharge hydraulic line and by way of another passage periodically blocked by the control valve is connected to the chamber of the housing communicating with the pressure hydraulic line.

A disadvantage of the above device resides in that the control valve spring weakens in the course of operation, which results in delayed closing of the overflow passage by the control valve and, consequently, in reduced frequency of percussions, impact power and the efficiency of the percussive tool. Therefore, the above construction fails to provide high frequency percussions because of the relatively delayed action of the control valve and limited service life of the valve spring.

In addition, acceleration of the piston hammer causes a recoil reaction acting upon the housing which is either hand-operated or mounted on a machine. The value of the recoil reaction is determined by the active area of the piston hammer and that of the housing on the side of the pneumatic accumulator. The recoil reaction acts to limit the impact power of the piston hammer thereby reducing impact strength and efficiency of the device. Also, the recoil reaction alternates because the piston hammer reciprocates relative to the stationary housing.

It is therefore an object of this invention to make the recoil reaction of a hydropneumatic percussive tool consistant in direction and minimal in value.

Another object is to improve the efficiency of the hydropneumatic percussive tool.

Still another object is to improve the operational stability of a hydraluic distributor of the hydropneumatic percussive tool and improve the reliability thereof.

One more object is to provide a hydropneumatic percussive tool of reduced weight and size.

SUMMARY DESCRIPTION

These and other objects are attained by that in a hydropneumatic percussive tool comprising a housing having an implement and radial passages communicating with a hydraulic pressure line and a hydraulic discharge line, a piston hammer of stepped configuration arranged inside the housing and having portions of larger and smaller diameters separating the housing into three chambers, one of the chambers being in communication with the pressure hydraulic line, another chamber communicating with the discharge hydraulic line, yet another one being intended to be filled with a compressed gas and serve as a pneumatic accumulator, and a hydraulic distributor having arranged in a cylindrical chamber thereof a control valve separating this chamber into two portions, one such portion being adapted to continuously communicate by way of one passage of the hydraulic distributor with the second chamber of the housing connected to the discharge hydraulic line by way of a port periodically blocked by the control valve connected to the third chamber of the housing which in turn communicates with the pressure hydraulic line, according to the invention, the tool is provided with a casing accommodating for axial reciprocations the housing, the latter having arranged coaxially with the implement an axially movable tubular element one end of which is introduced into the third chamber of the housing filled with the compressed gas, the other end thereof being adapted to cooperate with the casing to transmit thereto a force developed by the compressed gas, the piston hammer having an annular groove connected by way of one more passage to a second portion of the cylindrical chamber of the hydraulic distributor, the distance between the radial passages connected to the pressure and discharge hydraulic lines being a multiple of a maximum distance between the implement and the piston hammer.

The herein proposed hydropneumatic percussive tool has the housing which is axially reciprocating but failing to contact the operator and therefore failing to transmit vibration thereto. In addition, the housing performs a useful function, particularly strikes against the implement at the end of its work stroke. The provision of the tubular element penetrating into the chamber of the pneumatic accumulator and rigidly connected to the casing ensures that the recoil reaction force transmitted to the handle of the percussive tool is of constant sign or consistant in direction. The recoil reaction is consistant due to the fact that the tubular element transmits the force produced by the overpressure in the pneumatic accumulator, the value of this force being determined by the value of pressure of the compressed gas and the effective area of the tubular element, this area can be selected depending on the specified requirements. The groove made on the piston hammer in conjunction with an additional passage of the hydraulic distributor provide a two-stage distributor ensuring stable operation of the percussive tool. According to another aspect of the invention, it is important that the distance between the radial passages of the housing should equal to or be a multiple of the maximum distance between the piston hammer and the implement because only through meeting this requirement it is possible to ensure that the control valve switches over when the piston hammer and the housing reach their extreme positions in the course of their respective work and idle strokes thereby allowing for a most complete and maximum transfer of impact energy therefrom.

Preferably, the tubular element has an annular groove, while the housing is provided with radial passages arranged opposite to this groove and adapted to communicate with the pressure and discharge hydraulic lines to define in conjunction with the annular groove of the tubular element a starting distributor, the distance between these radial passages and the length of this annular groove being determined respectively by:

$$X_M = X_k + d_M + \delta,$$

$$l_p = X_M + X_k + d_M,$$

where $l_p$ is the length of the groove;

$X_M$ is the distance between the radial passages;

$X_k$ is the work stroke of the housing;

$d_M$ is the diameter of the radial passages; and $\delta$ is the amount of blocking by the tubular element of the radial passage connected to the discharge hydraulic line in the course of operation of the percussive tool.

The above construction of the tubular element makes it possible to use this element as a starting distributor. The tool is actuated when the operator applies pressure to the handle directed towards the material or object to be worked. This greatly simplifies handling of the percussive tool, since in this case the need for additional starting elements is obviated. In addition, the tubular element further functions as a means for filling the pneumatic accumulator with a compressed gas.

According to one modification of the hydropneumatic percussive tool embodying the present invention the hydraulic distributor is mounted on the housing, the annular groove being provided on the portion of larger diameter of the piston hammer, the casing of the percussive tool having a recess or slot to provide for movement of the hydraulic distributor together with the housing. In this modification the distance between the radial passages of the housing connected to the pressure and discharge hydraulic lines is equal to two maximum distances between the implement and the piston hammer.

The attached arrangement of the hydraulic distributor enables to provide reliable low-noise, low-vibration and efficient percussive tools despite the fact that they may be lighter in weight. The structural simplicity and the one-piece construction of the piston hammer make it possible to design both hand-operated hammers or concrete breakers and larger multi-purpose hammers to be mounted on hydraulically operated power shovels. The ratio between the passages of the housing connected to the pressure and discharge hydraulic lines and the maximum distance between the piston hammer and the implement is two to one in the above arrangement; this being so because the radial passages are disposed in the housing, while the annular groove in made on the piston hammer. The annular groove continuously communicates with the passage connected to the cylindrical interior of the hydraulic distributor. This passage must alternately communicate with the passages connected to the pressure and discharge hydraulic lines in the extreme points of the work and idle strokes, otherwise the passages will not communicate.

In another modification of the hydropneumatic percussive tool the hydraulic distributor is arranged internally of the piston hammer, whike the distance between the radial passages of the housing connected to the pressure and discharge hydraulic lines is equal to the maximum distance between the implement and the piston hammer.

The arrangement of the hydraulic distributor internally of the piston hammer makes it possible to provide vibration-free and compact hand-operatied machines. These machines are lighter in weight and shorther in length than analogous machines of the first modification, since the distance between the passages of the housing is equal to the maximum distance between the piston hammer and the implement, which reduces the length of the piston hammer and consequently that of the percussive tool. In the heretofore described arrangement the hydraulic distributor and hence the radial passage connected to the cylindrical chamber of the hydraulic distributor are located inside the movable piston hammer, while in order to ensure alternate communication of this passage in the extreme points of the work and idle strokes with the passages of the housing it is sufficient for the distance between these passages to be equal to the maximum distance between the piston hammer and the implement. However, this arrangement requires that the diameter of the piston hammer must not be less than a certain value because of the hydraulic distributor being located inside the piston hammer. This arrangement is most preferable for percussive tools of more than 8 kg in weight.

One more modification of the hydropneumatic percussive tool provides that an additional groove be arranged on the piston hammer, the two grooves being made on the steps of smaller diameter of the piston hammer, the housing being provided with an additional passage continuously connected to the second part of the cylindrical chamber of the hydraulic distributor and communicating with the additional groove during closing the radial passage of the housing which communicates with the discharge line by the portion of larger diameter of the piston hammer, the distance between the grooves being determined by:

$$l_s = X_R + \delta,$$

where $l_s$ is the distance between the grooves;

$X_R$ is the required value of the work stroke of the piston hammer and the housing; and $\delta$ is the amount of closing of the additional groove at the end of the idle stroke of the piston hammer.

When designing hand-operated percussive tools of less than 8 kg in weight it is preferable to employ the arrangement with externally mounted hydraulic distributor and grooves made on the smaller steps of the piston hammer. It has the advantages of the first modification in terms of structural simplicity and the one-piece construction of the piston hammer, as well as the advantages of the second modification in terms of the minimal length of the piston hammer and consequently the overall size of the percussive tool.

According to one more aspect of the present invention, the pneumatic accumulator is provided with an additional piston of stepped configuration facing by the step of larger diameter the tubular element, the step of smaller diameter being adapted to contact the end face of the piston hammer.

The use of the additional piston makes it possible to select the diameter of the piston hammer and reduce the pressure of gas in the pneumatic accumulator.

THE DRAWING

Other objects and advantages of this invention will become more fully apparent from a more detailed description of the exemplary embodiments thereof taken in conjunction with the accompanying drawings, in which.

DETAILED DESCRIPTION

Figure 1:
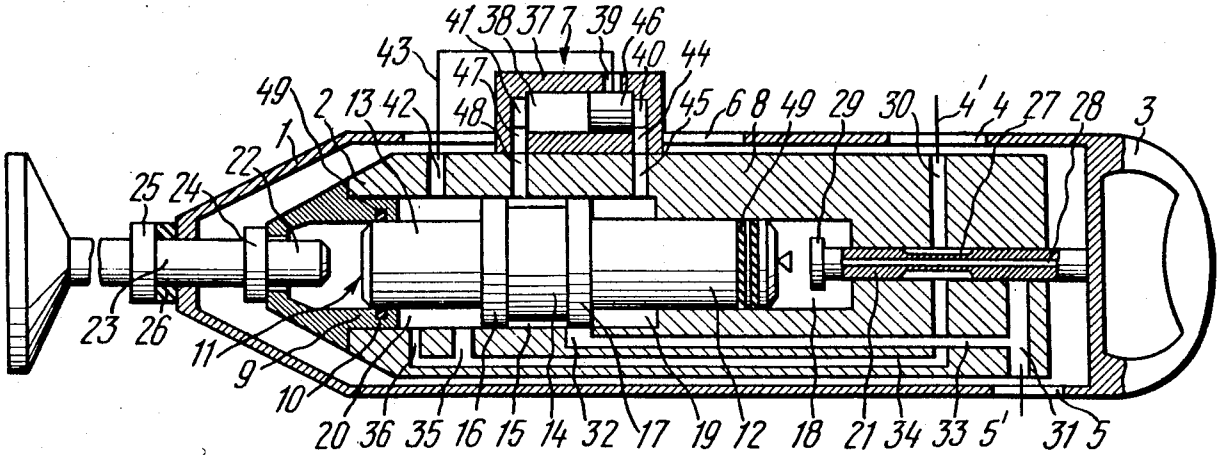
FIG. 1 is a diagrammatic view of a hydropneumatic percussive tool.

With reference to FIG. 1 there is shown a hydropneumatic percussive tool comprising a casing 1 having arranged in the interior thereof for axial reciprocations a housing 2. The casing 1 is provided with a handle 3 for holding the tool by the operator. Also provided in the casing 1 are recesses 4 and 5 for connection with pressure and discharge hydraulic lines 4' and 5', as well as a recess 6 for providing the movement of the housing 2 and a hydraulic distributor 7 secured on the housing 2. The housing 2 is of generally cylindrical shape and has a stepped interior having a step 8. The front end portion of the housing 2 accommodates a sleeve 9 having a step 10. Indicated by 11 is a piston hammer of stepped configuration having portions 12 and 13 of smaller diameter and a portion 14 of larger diameter. The portion 14 of the piston hammer 11 has an annular groove 15 between two collars 16 and 17. The piston hammer 11, the housing 2 and the sleeve 9 define three chambers 18, 19 and 20 of variable volume determined by the position of the piston hammer 11. The chamber 18 is intended to be filled with a compressed gas and serves as a pneumatic accumulator. The chamber 18 accommodates axially relative to the internal surface of the housing 2 the portion 12 of the piston hammer 11 to be acted upon by the compressed gas. This chamber 18 receives from the side thereof opposite to the piston hammer 11 one of the ends of a tubular element 21 arranged in the housing 2 coaxially with the piston hammer 11. The other end of the tubular element 21 cooperates with the end face of the casing 1. The sleeve 9 has an axial opening adapted to receive from one end thereof the portion 13 of the piston hammer 11, the opposite end of the sleeve receiving a shank 22 of an implement 23 disposed coaxially with the piston hammer 11. The implement 23, in the case shown in FIG. 1 a soil compacting means, may be replaced by a pick for crushing hard surfaces or by any other suitable implement. The implement 23 has two collars 24 and 25. The collar 24 mounts the sleeve 9 of the housing 2, while the collar 25 serves to mount the casing 1. Interposed between the collar 25 and the casing 1 is a resilient element 26 to soften the contact with the casing 1.

The tubular element 21 has a grooved portion 27 an axial passage 28 intended for admitting a compressed gas into the chamber 18 prior to operation and for compensating gas leaks in the course of operation, and a check valve 29 serving to hold the compressed air in the chamber 18. The check valve 29 is of any known suitable design not to be described hereinafter. Disposed in opposition to the grooved portion 27 of the tubular element 21 are radial passages 30 and 31 arranged in the housing 2 and communicated with the pressure and discharge hydraulic lines 4' and 5'. The discharge hydraulic line 5' communicates with a drain tank (not shown). The tubular element 21 with the grooved portion 27 and the radial passages 30 and 31 of the housing 2 define a start-up distributor for starting the tool. The chamber 19 is intended to discharge the working fluid or oil and communicates via a radial passage 32 and a discharge passageway 33 arranged inside the housing 2 with the passage 31. The chamber 20 serves to accept the working fluid, in this case an oil from an injector in the form of a pump of any known suitable design by way of the passage 30, a pressure passageway 34 and passages 35 and 36 arranged in the housing 2.

The distributor 7 serves to communicate or discommunicate the chambers 19 and 20 during work and return strokes of the percussive tool, as well as to ensure the automatic mode of operation thereof. The distributor 7 has a housing 37 provided with a cylindrical chamber 38. The housing 37 of the distributor 7 has ports 39, 40 and 41.

The port 39 is communicated with the chamber 20 by way of a passage 42 made in the housing 2 and an elastic pipe or hose 43 which also functions as a hydraulic accumulator. The port 40 is connected to the chamber 19 by a passage 44 made in the housing 37 of the distributor 7 and a passage 45 made in the housing 2 of the hydropneumatic percussive tool.

The chamber 38 of the hydraulic distributor 7 has a control valve 46 the cylindrical side surface of which is intended to open and close the port 39, the end face of the control valve 46 acting to open and close the port 40.

The cylindrical chamber 38 communicates via the port 41 and a passage 47 of the housing 38 of the distributor 7 and a passage 48 of the housing 2 with the annular groove 15 of the portion 14 of the piston hammer 11.

The passage 45 of the housing 2 is arranged so as to constantly communicate the port 40 and the passage 44 of the distributor 7 with the chamber 19 when the collar 17 of the piston hammer 11 closes the passage 31. For this purpose the passage 45 is disposed closer to the step 8 of the housing 2 than the passage 32. The difference of positioning between the passages 32 and 45 is chosen such as to provide a closed volume of oil in the chamber 19 required to move control valve 46 to thereby open the port 39.

The length of the annular groove 15 of the piston hammer 11 is selected such as to equal the maximum distance between the shank 22 of the implement 23 and the portion 13 of the piston hammer 11, whereas the distance between the passages 32 and 35 must equal a double of this maximum distance to provide for alternate communication of the passages 32 and 35 of the housing 2 with the passage 48 of the distributor 7 in the extreme points of the idle and work strokes.

The portion 12 of the piston hammer 11 has a hydraulic lock (not shown) of any known suitable design not to be described hereinafter; the hydraulic lock being intended to provide for hermeticity between the chambers 18 and 19. Sealing rings 49 are provided to prevent leakage of oil at the portion 12 of the piston hammer 11 and the step 10 of the sleeve 9.

The hydropneumatic percussive tool according to the invention operates in the following manner.

Prior to operation the chamber 18 is filled with an inert gas, such as nitrogen or carbon dioxide, or alternatively with a compressed air admitted along the passage 28 of the tubular element 21 from a compressed gas tank or a compressor of any known suitable construction.

Prior to starting the pump or in the absence of pressure applied to the handle 3, the pressure of the compressed gas in the chamber 18 acts to move the piston hammer 11 and the implement 23 in their leftmost position, whereas the casing 1 and the tubular element 21 stay in the rightmost position relative to the housing 2. The casing 1 is thrust against the collar 24 of the implement 23, the collar 16 of the piston hammer 11 assuming a position between the passages 35 and 36 of the housing 2, the passage 35 communicating with the chamber 38 via the annular groove 15, the passages 47 and 48 and the port 41, whereas the collar 17 fails to cover the passage 32. The passages 30 and 31 of the housing 2 are interconnected by way of the groove 27 of the tubular element 21.

Upon the engagement of the pump the oil being pumped is admitted through the pressure hydraulic line 4' into the passage 30, the annular groove 27, the pressure and discharge passageways 34 and 33, passages 32, 35 and 36, the chambers 19 and 20 and further through the passages 42, 47, **48*b* into the chamber 38. Due to the equal pressures in the chambers 19 and 20 the piston hammer 11 and the housing 2 stay at rest; also, the movement of these two elements is further prevented by the resistance of the compressed gas in the chamber 18, while the oil tends to choose the path of least resistance and travel from the passage 30 via the annular groove 27 into the passage 31 and further through the discharge hydraulic line 5'** for discharge.

If pressure is applied to the handle 3, the casing 1 tends to move leftwards (FIG. 1) relative to the implement 23 pressed against the ground and by compressing the elastic element 26 seats softly onto the collar 25 of the implement 23. The movement of the casing 1 also causes the tubular element 21 to move thereby separating the passage 31 from the passage 30. In this position the oil is conveyed from the pressure line 4' via the passage 30, the annular groove 27, the pressure passageway 34 and the passages 35 and 36 into the chamber 20 and then through the annular groove 15, the passages 48 and 47, and via the port 41 into the chamber 38 causing the valve 46 to move rightwards (FIG. 1) until it closes the ports 39 and 40.

The oil supplied under pressure into the chamber 20 acts on the housing 2 and the piston hammer 11 and causes the housing 2 to move to the left (FIG. 1) until it comes into contact with the collar 24 of the implement shank, which constitutes a working stroke of the housing 2. This is followed by the piston hammer tending to move to the right (FIG. 1) relative to the immobile housing 2 and implement 23 to compress the gas in the chamber 18 (idle stroke of the piston hammer 11). This alternate movement of the housing 2 and the piston hammer 11 is determined by varying in value forces acting thereon from the side of the pressurized gas chamber 18 at essentially equal forces acting thereon from the sides of the chambers 19 and 20. The control valve 46 stays in a position whereby it closes the port 39. In addition, oil under pressure tends to enter the elastic hose 43 the walls of which tend to stretch to accumulate or store a certain volume of oil under pressure which is equal to the oil pressure produced by the pump.

A further movement of the piston hammer 11 results in that its collar 17 closes the passage 32 of the housing 2 thereby discommunicating the passage 32 from the chamber 19 to form in the latter a closed volume. Therewith, the chamber 38 is connected with the discharge line through the port 41, the chambers 47 and 48, the annular groove 15 and the passage 32.

The oil continuing to enter from the pump into the chamber 20, the piston hammer 11 tends to move further right (FIG. 1) for the collar 17 of the step 14 of the piston hammer 11 to act on the oil occupying the closed volume of the chamber 19 and displace this volume of oil via the passage 45 of the housing 2, the passage 44 and the port 40. The oil forced out of the chamber 19 makes the control valve 46 move leftwards to open the port 39 connected with the hydraulic accumulator 43, the added volume of oil from the hydraulic accumulator 43 also acting on the control valve 46 to move it to the left and open the port 39 with great rapidity and thus communicating the chambers 19 and 20. A further movement of the control valve 46 results in that the oil is caused to flow from the chamber 38 through the port 41, the passages 47 and 48, the annlar groove 15 and the passage 32 into the passageway 33, the passage 31 and along the discharge line 5' for discharge.

The intercommunication of the chambers 19 and 20 leads to equalization of the oil pressure therein. On the other hand, the energy of compressed gas in the chamber 18 causes the piston hammer 11 and the housing 2 to travel in the opposite directions; more particularly, the piston hammer 11 moves to the left as seen best in FIG. 1, while the housing 2 moves to the right thereby effecting working and idle strokes, respectively. In the course of the working stroke of the piston hammer 11 and the idle stroke of the housing 2 the oil is being forced out of the chamber 20 through the passage 42, the hose 43, ports 39 and 40, passages 44 and 45 into the chamber 19. The volume of oil thus displaced from the chamber 20 is equal to the volume of the chamber 19. At the end of the work stroke the piston hammer makes an impact against the shank 22 of the implement 23.

Thereupon, the collar 16 of the piston hammer 11 closes the passage 42 of the housing 2 discommunicating the chamber 20 and the oil pump from the chamber 19, whereas the chamber 38 is communicated with the pump and the chamber 20 by way of the passage 35, the annular groove 15, passages 48 and 47, and the port 41; the port 40 being communicated with the discharge passage 33 by way of the passages 44 and 45, the chamber 19, and the passage 32. Such a communication of the chamber 38 with the oil pump and the chamber 20 on the one hand, and the communication of the port 40 with the discharge passageway 33 on the other are attained by that the distance between the passages 32 and 35 of the housing 2 is equal to two maximum distances between the shank 22 of the implement 23 and the piston hammer 11.

Under the action of the flow of oil delivered from the oil pump and forced out from the chamber 20 the control valve 46 is caused to momentarily move into the rightmost position to thereby close the port 39.

The flow of oil entering the chamber 20 causes the housing 2 to stop and end its idle stroke, whereafter the housing 2 begins its work stroke at the end of which it strikes the collar 24 of the implement 23, whereafter cycle is recommenced.

When the pressure on the handle 3 is released, the compressed gas in the chamber 18 acts on the tubular element 21 to move it to the right as can be seen from FIG. 1 to thus communicate the passages 30 and 31 by way of the grooved portion 27 thereof and convey the incoming flow of oil for discharge. Therewith, the force produced by the compressed gas is transmitted by way of the tubular element 21 to the casing 1 for it to be moved to the right until it comes into contact with the collar 24 of the implement 23, the piston hammer 11 and the implement moving leftwards relative to the housing 2; otherwise stated, the percussive tool assumes the initial position.

Figure 2:
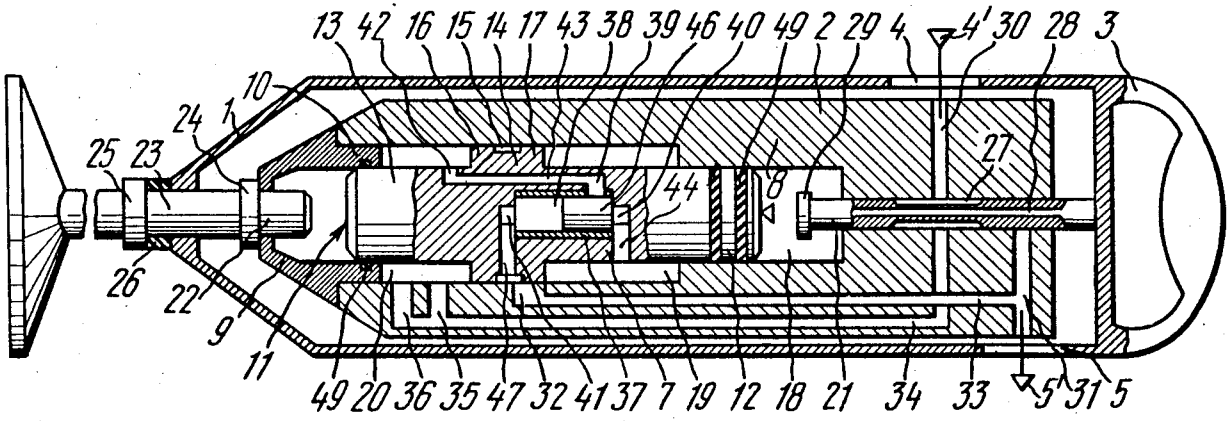
FIG. 2 is a diagrammatic view of a modification of the hydropneumatic percussive tool according to the invention.

With reference to FIG. 2, there is shown another modification of the hydropneumatic percussive tool comprising basically the same elements as the modification illustrated in FIG. 1, the difference being in that in the percussive tool according to FIG. 1 the hydraulic distributor 7 is attached to the housing 2, whereas in the modification of FIG. 2 this hydraulic distributor 7 is secured inside the piston hammer 11. Therefore, the aperture of recess 6 can be dispensed with. The hydraulic distributor 7 is also structurally modified, although it is likewise provided with the housing 37 having the cylindrical chamber 38, the housing also having ports 39, 40 and 41.

The port 39 is connected with the chamber 20 by way of the passage 42 and the axial passageway 43 arranged inside the body of the piston hammer 11. The port 40 is connected with the chamber 19 by way of the passage 44 also arranged inside the body of the piston hammer 11. The chamber 38 of the hydraulic distributor 7 has the control valve 46 the cylindrical side surface of which is intended to open and close the port 39, the end face of this control valve 46 serving to block the port 40. The cylindrical chamber 38 is adapted to communicate with the annular groove 15 of the larger step 14 of the piston hammer 11 via the port 41 and the passage 47. The passage 44 of the piston hammer 11 is arranged such that it continuously communicates the port 40 with the chamber 19.

The modification of the hydropneumatic percussive tool shown in FIG. 2 operates similarly to the tool illustrated in FIG. 1, the passages 45 and 48 being missing.

At the end of a work stroke the piston hammer 11 strikes the shank 22 of the implement 23. Therewith, the passage 42 of the piston hammer 11 is blocked by the step 10 of the sleeve 9 making up the housing 2, thereby discommunicating the chamber 19 from the chamber 20 and the oil pump, whereas the chamber 38 is communicated with the oil pump and the chamber 20 through the passage 35, the annular groove 15, the passage 47, and the port 41; the port 40 communicating with the discharge passageway 33 via the passage 44, chamber 19 and passage 32. The communication of the chamber 38 with the oil pump and the chamber 20 on the one hand, and the communication of the port 40 with the passage 32 and the drain passageway 33 on the other, are attained by that the distance between the passages 32 and 35 in the housing 2 is equal to a maximum distance between the shank 22 of the implement 23 and the piston hammer 11.

Figure 3:
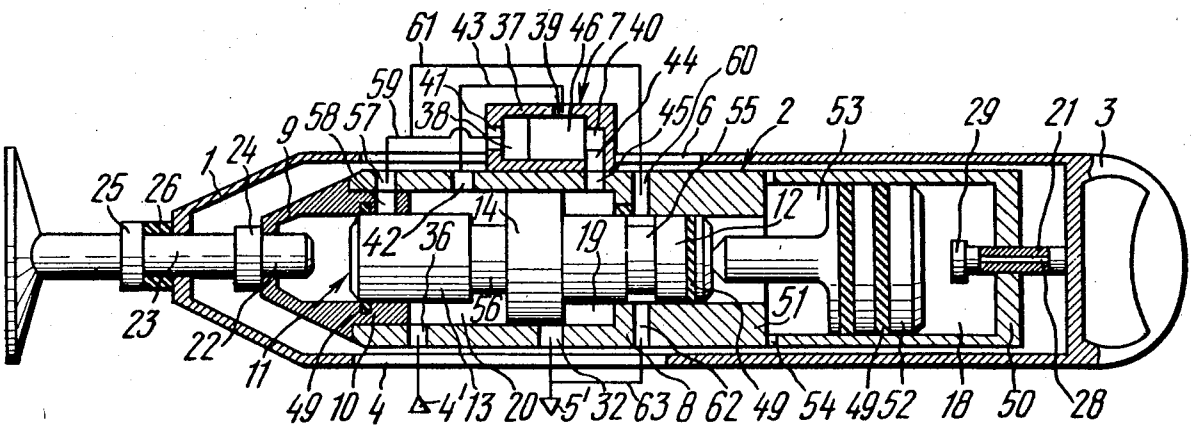
FIG. 3 is a diagrammatic view of one more modification of the hydropneumatic tool according to the invention.

Referring now to FIG. 3, there is shown one more modified form of a hydropneumatic percussive tool according to the invention wherein the housing 2 is of multi-piece construction comprising portions 50, 51 and the sleeve 9. In the portion 50 of the housing 2 there is provided an additional piston 52 of stepped configuration arranged coaxially with the piston hammer 11 and intended to transmit a force produced by the compressed gas to the piston hammer 11. This additional piston 52 by the step thereof having a larger diameter defines with the portion 50 of the housing 2 the chamber 18, whereas the step of the piston 52 having smaller diameter is adapted to cooperate with the portion 12 of the piston hammer 11, a chamber 53 being thereby formed which communicates with the atmosphere by way of passages 54 arranged in the portion 50 of the housing 2. The chamber 19 has a radial passage 32 connected to the discharge line 5', the chamber 20 having the radial passage 36 put into communication with the pressure line 4'.

The piston hammer 11 has annular grooves 55 and 56 arranged on the portions 12 and 13 of smaller diameter. The length of the annular groove 55 is equal to the stroke of the piston hammer 11 necessary to open by the control valve 46 the port 39. The length of the annular groove 56 equals a maximum value of the depth at which the implement 23 penetrates the ground. The annular groove 56 serves to communicate passages 57 and 58 at the end of the work stroke of the piston hammer 11, whereas the annular groove 55 is intended to communicate passages 60 and 62 when the passage 32 is blocked by the portion 14 of the piston hammer 11.

The annular grooves 55 and 56 are spaced from one another a distance equal to the maximum length of the work stroke of the piston hammer 11 and the housing 2. The passages 57 and 58 arranged in the housing 2 and the step 10 of the sleeve 9 are connected by a line 59 with the port 41 of the hydraulic distributor housing 37, the line 59 being connected with the passage 60 of the housing 2 by means of a line 61. The distance between the passages 45 and 60 is equal to the length of the annular groove 55. Arranged in opposition to the passage 60 in the housing 2 is the passage 62 communicating with the discharge line 5' through a line 63.

A hydraulic lock (not shown) is provided in the additional piston 52.

The modification of the hydropneumatic percussive tool just described operates as follows.

Prior to operation the chamber 18 is filled with a compressed gas delivered from a compressor via the passage 28 of the tubular element 21. In the absence of pressure on the handle 3 the compressed gas in the chamber 18 tends to hold the piston hammer 11, the piston 52 and the implement 23 in the leftomost position as viewed according to FIG. 3, the casing 1 thrusting against the collar 24 of the implement 23.

When pressure is applied to the handle 3, the casing 1 moves to the left relative to the implement 23 jammed in the material being worked and while compressing the resilient element 26 tends to softly seat on the collar 25, the piston hammer 11, piston 52, implement 23 and the housing 2 resting in the initial position prior to actuating the percussive tool. The passages 57, 58 and 36 of the housing 2 are interconnected by way of the annular groove 56; the passages 60 and 62 being blocked by the portion 12 of the piston hammer 11, the passage 32 not being blocked by the portion 14 of the piston hammer 11.

Upon the engagement of the oil pump, the oil is conveyed from the pressure line 4' into the passage 36 to flow further via the annular groove 56 into the passages 58 and 57, the line 59 and the port 41 to enter the chamber 38 thereby moving the valve means 46 rightwards until the ports 39 and 40 are closed.

The oil supplied under pressure to the chamber 20 acts on the housing 2 and the piston hammer 11 to move the housing 2 to the left until it strikes the collar 24. After the impact against the collar 24 the housing 2 stops thus ending its work stroke. Thereafter, the piston hammer 11 and the piston 52 move rightwards relative to the immobile housing 2 and implement 23 to thereby compress the gas in the chamber 18 (an idle stroke of the piston hammer and the additional piston). This alternate movement of the housing 2, the piston hammer 11 and the additional piston 52 is determined by varying in value forces acting on these three elements of the percussive tool produced by the gas occupying the chamber 18, the forces acting on the housing 2 and the piston hammer 11 from the chambers 19 and 20 being equal in value. Therewith, the control valve means 46 assumes a position to block the port 39, the oil under pressure being delivered into the elastic line 43.

A further movement of the piston hammer 11 results in that its portion 14 blocks the passage 32 thereby discommunicating it from the chamber 19 to form a closed volume therein, the passages 60 and 62 starting to interconnect by way of the annular groove 55.

The oil continuing to be delivered from the oil pump into the chamber 20, the piston hammer 11 is moved to the right, the portion 14 of the piston hammer 11 forcing the oil contained in the closed volume of the chamber 19 through the passage 45 of the housing 2, the passage 44 and the port 40. The oil thus driven out of the closed volume in the chamber 19 acts on the control valve 46 to move it to the left thereby opening the port 39 and intercommunicating the chambers 19 and 20. The movement of the control valve 46 causes the oil in the chamber 38 to flow through the port 41, lines 59 and 61 and the passage 60, and further through the annular groove 55, passage 62 and the line 63 to enter the discharge line 5' and be discharged.

The intercommunication of the chambers 19 and 20 resulats in that the oil pressure in them tends to equalize. By virtue of the energy of the compressed gas in the chamber 18 the piston hammer 11, the piston 52 and the housing 2 tend to move promptly in the opposite directions, that is the piston hammer 11 and the additional piston 52 move to the left if viewed according to FIG. 3, while the housing 2 moves to the right (constituting the work stroke of the piston hammer and the additional piston and the idle stroke of the housing). In the course of the work stroke of the piston hammer 11 and the additional piston 52 on the one hand, and the idle stroke of the housing 2 on the other, the oil is forced out of the chamber 20 into the chamber 19 via the passage 42, line 43, ports 39 and 40, and the passages 44 and 45, the amount of oil thus displaced from the chamber 20 being equal in volume to the volume of the chamber 19.

At the end of the work stroke the hammer piston 11 strikes against the shank 22 of the implement 23, the portion 14 of the piston hammer 11 blocking the passage 42 and discommunicating the chamber 20 and the oil pump from the chamber 19, whereas the chamber 38 is communicated with the oil pump and the chamber 20 via the groove 56, passages 58 and 57, line 59 and port 41. The passages 60 and 62 are blocked by the portion 12 of the piston hammer 11, the port 40 being communicated with the discharge line 5' by way of the passages 44 and 45, the chamber 19 and passage 32.

Under the action of the total flow of oil delivered from the oil pump and from the chamber 20, the valve means 46 promptly moves to the extreme right position to block the port 39.

The oil coming into the chamber 20 makes the housing 2 stop thereby ending its idle stroke, whereafter the housing begins its work stroke ending by an impact against the collar 24 of the implement 23 to be followed by the recommencement of the cycle.

With the oil pump disengaged, the pressure of gas in the chamber 18 causes the piston hammer 11, additional piston 52 and the implement 23 to assume the leftmost position, while the tubular element 21 and the casing 1 take the rightmost position relative to the housing 2 to thereby restore the initial position of the percussive tool.

It must be noted that in the construction of the hydropneumatic percussive tool with reference to FIG. 3 use can be made of a starting distributor described with reference to FIGS. 1 and 2.

It should also be noted that the additional piston 52 transmitting the energy of the compressed gas to the piston hammer 11 can be employed in the constructions described heretofore with reference to FIGS. 1 and 2.

The modifications of the hydropneumatic percussive tool illustrated in FIGS. 1, 2 and 3 can preferably be used manually operated tools for ground compacting.

They can be further used for designing various mounted hydraulic hammers. It stands to reason that those skilled in the art may introduce to the heretofore described constructions of the hydropneumatic percussive tool described as non-exhaustive examples various modifications within the spirit and scope of the present invention.

When designing such other tools one should proceed from such major factors as: impact energy of the piston hammer; delivery rate and pressure of the oil pump; recoil reaction value R; mass and overall dimensions.

From the dimensions and pump pressure a maximum gas pressure F in the pneumatic accumulator is found. Knowing the values of F and R the diameter of tubular element is then determined. According to the value of F and a required impact energy the work stroke of the piston hammer and that of the housing are found which in turn determine the rapidity or frequency of impacts effected by the piston hammer and the housing and, consequently, the impact power, capacity, efficiency of the percussive tool and other parameters, all the abovementioned values being closely interconnected.

It should be further noted by way of example that pilot models of a hydropneumatic percussive tool embodying the present invention have been successfully tested and featured the following parameters:

| | |
|---|---|
| (1) Energy of a single impact made by the hammer piston | 50 j |
| (2) Impact frequency of the piston hammer | 27 Hz |
| (3) Impact frequency of the housing | 27 Hz |
| (4) Energy of a single impact made by the housing | 30 j |
| (5) Pressure of gas being pumped in | 0.8 MPa |
| (6) Length of acceleration (work stroke) of the piston hammer | 25–30 mm |
| (7) Diameter of the tubular element | 12 mm |
| (8) Mass | 9.2–9.6 kg |
| (9) Dimensions: | |
| length without an implement | 630 mm |
| width of the protruding portions | 66 mm and 80 mm |
| (10) Recoil reaction value | 200 n |
| (11) Oil pump delivery rate | 0.0011 $m^3/s$ |
| (12) Pressure developed by the pump | 10 MPa |

What is claimed is:

1. A hydropneumatic percussive tool comprising:

(a) a casing;

(b) a hollow housing having radial passages therein and mounted in the interior of said casing for axial reciprocations therein;

(c) an implement secured in said casing, a shank of said implement being inserted into the interior of said housing;

(d) a piston hammer of stepped configuration having an annular groove therein, said piston hammer being disposed in the interior of said housing and having portions of larger and smaller diameters to separate said housing into three chambers, one of said chambers being in communication with a pressure passageway through one of said radial passages, another one communicating through another said radial passage with a discharge passageway, whereas yet another one is intended to be filled with a compressed gas to serve as a pneumatic accumulator;

(e) the distance between said radial passages of said housing connected to said pressure and discharge passageways being a multiple of the maximum distance between said implement and said piston hammer;

(f) a tubular element arranged inside said housing coaxially with said implement for axial reciprocation, one end of said tubular element penetrating said pneumatic accumulator, the other end thereof cooperating with said casing to transmit thereto a force from said pneumatic accumulator;

(g) said implement and said tubular element mounting said housing in said casing for axial reciprocation;

(h) a hydraulic distributor having a cylindrical chamber which accommodates a control valve means separating this chamber into two portions, one such portion being adapted to continuously communicate by way of one of said radial passages with said chamber connected to said discharge passageway, the other portion communicating through another of said radial passages connected to a hollow formed by said annular groove on said piston hammer, the side surface of said hydraulic distributor having a port periodically blocked by said valve means and communicating through yet another of said radial passages with said chamber connected to said pressure passageway; and (i) said hydraulic distributor is disposed inside said piston hammer, the distance between said radial passages connected to said pressure and discharge passageways being equal to the maximum distance between said implement and said piston hammer.

2. A hydropneumatic percussive tool as set forth in claim 1 wherein said pneumatic accumulator is provided with an additional piston of stepped configuration, the step of larger diameter facing said tubular element, the step of smaller diameter being adapted to cooperate with the end face of said piston hammer.

* * * * *